US009464539B2

(12) United States Patent
Son et al.

(10) Patent No.: US 9,464,539 B2
(45) Date of Patent: Oct. 11, 2016

(54) WASTE HEAT RECOVERY DEVICE FOR A MARINE VESSEL

(75) Inventors: Moon Ho Son, Geoje-si (KR); Gun Il Park, Geoje-si (KR); Sung Jae Lee, Geoje-si (KR); Ho Ki Lee, Geoje-si (KR); Jung Kun Jin, Pyeongtaek-si (KR); Jae Woong Choi, Geoje-si (KR)

(73) Assignee: SAMSUNG HEAVY IND. CO., LTD (KR)

( * ) Notice: Subject to any disclaimer, the term of this patent is extended or adjusted under 35 U.S.C. 154(b) by 658 days.

(21) Appl. No.: 14/364,655

(22) PCT Filed: Dec. 6, 2011

(86) PCT No.: PCT/KR2011/009379

§ 371 (c)(1),
(2), (4) Date: Jun. 11, 2014

(87) PCT Pub. No.: WO2012/081854

PCT Pub. Date: Jun. 21, 2012

(65) Prior Publication Data

US 2014/0345280 A1 Nov. 27, 2014

(30) Foreign Application Priority Data

| | | |
|---|---|---|
| Dec. 17, 2010 | (KR) | 10-2010-0129728 |
| May 16, 2011 | (KR) | 10-2011-0045819 |
| May 31, 2011 | (KR) | 10-2011-0052456 |
| May 31, 2011 | (KR) | 10-2011-0052514 |

(51) Int. Cl.

| | |
|---|---|
| ***F01K 15/04*** | (2006.01) |
| ***F01K 23/06*** | (2006.01) |
| ***F01K 25/08*** | (2006.01) |
| ***F01K 27/02*** | (2006.01) |
| ***F01K 23/10*** | (2006.01) |

(52) U.S. Cl.

CPC ..... *F01K 15/04* (2013.01); *F01K 23/065* (2013.01); *F01K 23/10* (2013.01); *F01K 25/08* (2013.01); *F01K 27/02* (2013.01)

(58) Field of Classification Search

CPC ..... F01K 15/04; F01K 23/10; F01K 23/065; F01K 25/08; F01K 27/02

USPC ..... 60/605.1–612, 614, 616, 618

See application file for complete search history.

(56) References Cited

U.S. PATENT DOCUMENTS

| | | | | |
|---|---|---|---|---|
| 4,214,450 | A | 7/1980 | Nagashima et al. | |
| 4,363,703 | A * | 12/1982 | ElDifrawi | B01D 3/346 159/904 |

(Continued)

FOREIGN PATENT DOCUMENTS

| | | | |
|---|---|---|---|
| CN | 103380277 | A | 10/2013 |
| CN | 103775152 | A | 5/2014 |
| EP | 1925806 | A2 | 5/2008 |
| JP | 5672279 | | 5/1981 |
| JP | 2009236014 | A | 10/2009 |

(Continued)

*Primary Examiner* — Hoang Nguyen

(57) ABSTRACT

A waste heat recovery device for a marine vessel is disclosed. According to the embodiments of the present invention, the waste heat recovery device for a marine vessel includes: a heat exchanger, which recovers heat from the exhaust fumes discharged from the engine, to heat a first refrigerant under uniform pressure; a turbine which is driven by adiabatically expanding the first refrigerant heated under uniform pressure; a condenser which condenses the adiabatically expanded first refrigerant; and a heat exchanging pump which compresses the condensed first refrigerant so as to re-circulate the compressed first refrigerant to the heat exchanger.

9 Claims, 6 Drawing Sheets

(56) References Cited

U.S. PATENT DOCUMENTS

| | | | | |
|---|---|---|---|---|
| 2004/0060292 | A1* | 4/2004 | Minemi | F01B 17/04 60/616 |
| 2010/0319346 | A1* | 12/2010 | Ast | F01K 23/04 60/616 |
| 2011/0209473 | A1* | 9/2011 | Fritz | F01K 23/065 60/605.2 |
| 2013/0146250 | A1* | 6/2013 | Eller | F28F 21/08 165/47 |

FOREIGN PATENT DOCUMENTS

| | | | |
|---|---|---|---|
| JP | 2010164003 | A | 7/2010 |
| JP | 2012149541 | A | 8/2012 |
| JP | 2013124555 | A | 6/2013 |
| KR | 19820000996 | | 6/1982 |
| KR | 20100067247 | A | 6/2010 |
| KR | 20140049141 | A | 4/2014 |
| WO | 2012081854 | A2 | 6/2012 |

* cited by examiner

WASTE HEAT RECOVERY DEVICE FOR A MARINE VESSEL

TECHNICAL FIELD

The present invention relates to a waste heat recovery device for a marine vessel, and more particularly, to a waste heat recovery device for a marine vessel which recovers waste heat of a discharged gas that is discharged from an engine of a marine vessel.

BACKGROUND ART

Recently, as an era of a high oil price advents, efforts to save fuel costs by improving energy efficiency of marine vessels and to secure an environmentally friendly feature in operation of a marine vessel are being made.

In general, in an operation of a marine vessel, most energy is consumed by a main engine for propelling the marine vessel, and about 25% of fuel consumed for the operation of the main engine is practically disposed of in air as an exhaust fume. Accordingly, a variety of devices for recovering part of waste heat by using the exhaust fume are actively being introduced.

FIG. 1 is a schematic view illustrating a waste heat recovery device for a marine vessel of a related art. Referring to FIG. 1, in the waste heat recovery device for a marine vessel of a related art, a heat recovery device (boiler) 121 is installed at an exhaust pipe through which an exhaust fume is exhausted from an engine 110 of a marine vessel and then heat of the exhaust fume is recovered (heated under uniform pressure) so that high temperature steam is generated to be used as a variety of energy sources.

However, in the waste heat recovery device for a marine vessel of a related art, since waste heat of an exhaust fume is recovered through only the heat recovery device 121 having a single structure, waste heat of an exhaust fume that is still in a high temperature state even after having passed through the heat recover device 121 is not recovered and discharged into the air so that energy is wasted.

Also, a heat recovery device for recovering heat from coolers to cool the heat generated from the engine itself is not provided.

On the other hand, an operation rate of the engine 110 varies during the operation of a marine vessel. For example, the engine 110 of a marine vessel may be operated with a full load for about ⅔ of the entire operation days and with a load lower than the full load for the rest of the operation days. As such, when the engine 110 is operated with a load lower than the full load, a relatively low amount of exhaust fume is generated compared to the exhaust fume generated when the engine 110 is operated with a full load.

A change in the amount of an exhaust fume causes a change in heat capacity flowing in with the Rankine cycle, which has a severe influence on efficiency of the Rankine cycle. Accordingly, electricity may be stably generated when the above issue is considered in the development of a waste heat recovery device for a marine vessel which may drive a turbine by recovering a large amount of waste heat of an exhaust fume of an engine compared to the related art.

DETAILED DESCRIPTION OF THE INVENTION

Technical Problem

The present invention provides a waste heat recovery device for a marine vessel that may improve energy (electricity) generation ability by recovering a heat source of a discharged gas of an engine at its maximum, thereby driving a turbine.

Technical Solution

According to an aspect of the present invention, there is provided a waste heat recovery device for a marine vessel, which includes a heat exchanger recovering heat from an exhaust fume that is discharged from an engine and heating a first refrigerant under uniform pressure, a turbine driven by adiabatically expanding the first refrigerant that is heated under uniform pressure, a condenser condensing the first refrigerant that is adiabatically expanded, and a heat exchanging pump compressing the first refrigerant that is condensed, to be re-circulated in the heat exchanger.

The waste heat recovery device may further include a plurality of coolers that cool heat generated from the engine, in which the condensed first refrigerant receives heat from the plurality of coolers and is re-circulated in the heat exchanger.

The waste heat recovery device may further include a heat accumulator that supplies heat discharged from the turbine to the first refrigerant that is supplied to the heat exchanger.

The waste heat recovery device may further include a heat recovery device that is provided at a front end of the heat exchanger on an exhaust pipe through which the exhaust fume discharged from the engine passes, to recover heat of the exhaust fume separately from the heat exchanger.

The waste heat recovery device may further include an auxiliary turbine driven by adiabatically expanding a second refrigerant that is heated under uniform pressure by using heat recovered by the heat recovery device, an auxiliary condenser condensing the second refrigerant that is adiabatically expanded, and an auxiliary pump compressing the second refrigerant that is condensed, to be re-circulated in the heat recovery device.

The condenser may use seawater as a refrigerant.

The waste heat recovery device may further include a cooling line connected to the condenser to supply seawater to the condenser, and a cooling pump forcibly circulating the seawater through the cooling line.

The waste heat recovery device may further include a jacket cooler that cools the heat generated from the engine, in which the condensed first refrigerant receives heat from the jacket cooler to be re-circulated in the heat exchanger.

The waste heat recovery device may further include a condenser cooling line connected to the condenser to supply a third refrigerant to the condenser, the third refrigerant being a refrigerant of the condenser, a condenser cooling pump forcibly circulating the third refrigerant through the condenser cooling line, a seawater heat exchanger performing heat exchange between the third refrigerant and seawater, a seawater line connected to the seawater heat exchanger to supply the seawater to the seawater heat exchanger, and a seawater pump forcibly circulating the seawater through the seawater line.

The waste heat recovery device may further include a condenser cooling line connected to the condenser to supply a third refrigerant to the condenser, the third refrigerant being a refrigerant of the condenser, a condenser cooling pump forcibly circulating the third refrigerant through the condenser cooling line, a main cooler performing heat exchange between the third refrigerant and seawater and heat exchange between fresh water for cooling and the seawater, a seawater line connected to the main cooler to supply the seawater to the main cooler, and a seawater pump forcibly circulating the seawater through the seawater line.

The first refrigerant may be any one of ammonia, C2H6, C7H8, C8H16, R11, R113, R12, R123, R134a, and R245fa.

The waste heat recovery device may further include a turbo charger that is operated by the exhaust fume, in which the heat exchanger comprises a heat exchange portion that is arranged between the turbo charger and the turbine and performs heat exchange between an exhaust fume discharged from the turbo charger and the first refrigerant supplied to the turbine.

The heat exchanger may include at least one circulation pump for circulation of a heat transfer fluid that circulate in the heat exchange portion.

The heat exchange portion may include a first heat exchange unit performing heat exchange between the exhaust fume discharged from the turbo charger and heat of the heat transfer fluid, and a second heat exchange unit performing heat exchange between exhaust fume discharged from the first heat exchanger and the first refrigerant supplied to the turbine.

The heat exchange portion may further include a third heat exchange unit that is arranged at a front end of the first heat exchange unit and performs heat exchange between air supplied by the turbo charger and the heat transfer fluid to heat the heat transfer fluid.

The heat exchanger may further include a bypass portion that allows the heat transfer fluid to flow toward the first heat exchange unit bypassing the third heat exchange unit.

The bypass portion may further include a regulation valve to regulate a flow rate of the heat transfer fluid.

The regulation value may regulate a flow rate of the heat transfer fluid that is supplied to the third heat exchange unit, corresponding to a change in a load of the engine.

The heat exchanger may further include a storage unit that temporarily stores the heat transfer fluid.

The regulation value may regulate a flow rate of the heat transfer fluid that is supplied to the third heat exchange unit to maintain heat capacity supplied to the second heat exchanger unit in a constant level.

A temperature sensor to measure a temperature of the heat transfer fluid supplied to the second heat exchange unit may be provided at a front end of the second heat exchange unit, and the regulation valve may regulate a flow rate of the heat transfer fluid that is supplied to the third heat exchange unit to maintain the temperature of the heat transfer fluid supplied to the second heat exchanger unit in a constant level based on a value sensed by the temperature sensor.

The circulation pump may regulate a flow rate of the heat transfer fluid to maintain a temperature of the heat transfer fluid constant, the heat transfer fluid performing heat exchange with the first refrigerant.

Advantageous Effects

According to embodiments of the present invention, a heat source of a discharged gas of an engine is recovered at its maximum, thereby driving a plurality of turbines and thus energy (electricity) generation ability may be improved.

Also, electricity may be stably generated in spite of a change in a load of an engine by appropriately controlling a flow rate of a heat transfer fluid that circulates in a heat exchanger.

BEST MODE

Figure 1:
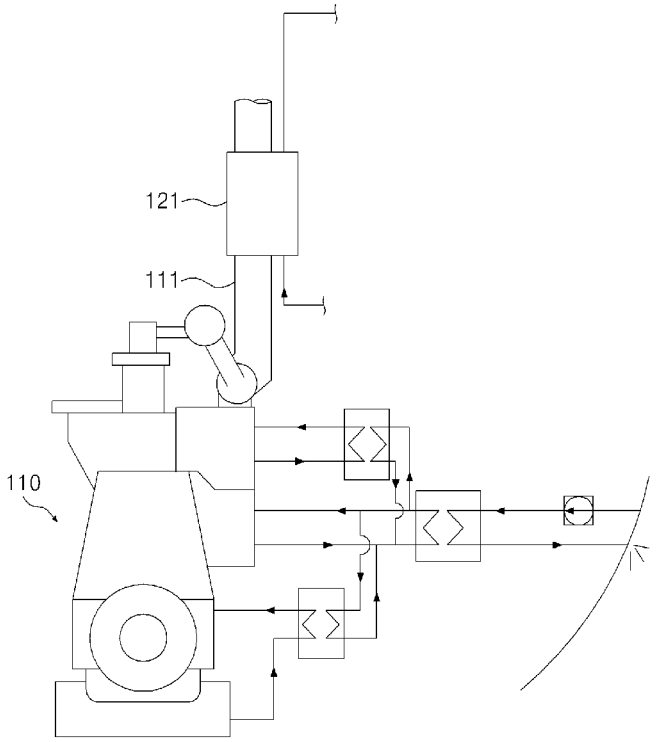
FIG. 1 is a schematic view of a waste heat recovery device for a marine vessel of a related art.

The attached drawings for illustrating preferred embodiments of the present invention are referred to in order to gain a sufficient understanding of the present invention, the merits thereof, and the objectives accomplished by the implementation of the present invention.

Hereinafter, the present invention will be described in detail by explaining preferred embodiments of the invention with reference to the attached drawings. Like reference numerals in the drawings denote like elements.

In the following descriptions of embodiments of the present invention, a term "heating under uniform pressure" is interpreted to be a term "heating under uniform pressure" that is used in thermodynamics, not to be a term meaning that heating is performed while a pressure is maintained to be mathematically or physically perfectly the same. Also, in the present specification, a term "adiabatic expansion" is interpreted in the same manner.

Figure 2:
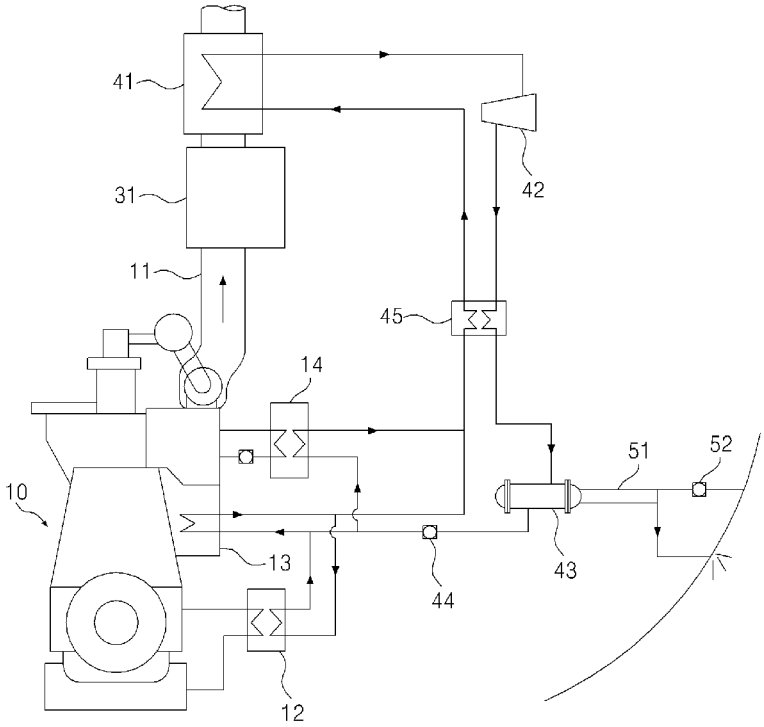
FIG. 2 is a schematic view of a waste heat recovery device for a marine vessel according to a 1st embodiment of the present invention.

FIG. 2 is a schematic view of a waste heat recovery device for a marine vessel according to a 1st embodiment of the present invention.

Referring to FIG. 2, the waste heat recovery device for a marine vessel according to the present embodiment includes a heat exchanger 41 heating a first refrigerant under uniform pressure by recovering heat from an exhaust fume that is discharged from an engine 10, a turbine 42 driven by adiabatically expanding the first refrigerant that is heated under uniform pressure, a condenser 43 condensing the first refrigerant that is adiabatically expanded, a heat exchanging pump 44 compressing the condensed first refrigerant to be re-circulated in the heat exchanger 41, and a heat recovery device 31 provided at the front end of the heat exchanger 41 on an exhaust pipe 11 through which the exhaust fume discharged from the engine 10 passes and recovering heat of the exhaust fume separately from the heat exchanger 41.

In the present embodiment, heat of the exhaust fume is recovered through the heat recovery device 31 that is provided on the exhaust pipe 11 of the engine 10 for discharging the exhaust fume, thereby generating steam to be used as various energy sources. Simultaneously, the heat exchanger 41 is additionally provided on the exhaust pipe 11 at the rear end of the heat recovery device 31, and the turbine 42 that is driven by using the heat recovered from the heat exchanger 41, the condenser that condenses the first refrigerant of the turbine 42, and the heat exchanging pump 44 that compresses condensate water (first refrigerant) are provided so that waste heat of the exhaust fume may be additionally recovered. The first refrigerant may be an organic compound, that is, any one of ammonia, C2H6, C7H8, C8H16, R11, R113, R12, R123, R134a, and R245fa.

However, the right scope of the present invention is not limited thereto. When the first refrigerant may recover waste heat from the high-temperature exhaust fume, the heat recovery device 31 may be omitted and also a refrigerant medium other than an organic compound may be used as the first refrigerant.

On the other hand, the waste heat recovery device for a marine vessel according to the present embodiment further includes a heat accumulator 45 that supplies the waste heat discharged from the turbine 42 to the first refrigerant that is provided to the heat exchanger 41. Accordingly, as the first refrigerant that receives the waste heat discharged from the turbine 42 is supplied to the heat exchanger 41, efficiency may be further improved.

Also, the engine 10 is provided with a plurality of coolers, that is, an oil cooler 12, an air cooler 13, and a jacket cooler 14, to cool the heat generated from the engine 10 itself. According to the present embodiment, to further improve efficiency of the waste heat recovery device for a marine vessel, the first refrigerant that is compressed in the heat exchanging pump 44 is configured to receive heat from the coolers 12, 13, and 14 and re-circulate in the heat exchanger 41.

On the other hand, seawater may be used as a refrigerant for the condenser 43. To supply seawater to the condenser 43, a cooling line 51 connected to the condenser 43 and a cooling pump 52 for forcibly circulating the seawater through the cooling line 51.

The operation of the waste heat recovery device for a marine vessel according to the first embodiment of the present invention is described below.

First, superheated steam is generated by recovering (heating under uniform pressure) the heat of the exhaust fume through the heat recovery device 31, to be used as various energy sources. Then, the heat of the exhaust fume that passed through the heat recovery device 31 is recovered (heated under uniform pressure) by the heat exchanger 41 so that the first refrigerant is in a superheated steam state. Next, as the first refrigerant is adiabatically expanded in the turbine 42, the turbine 42 is driven and the gas (the first refrigerant) discharged from the turbine 42 is cooled under uniform pressure by the refrigerant in the condenser 43 to be saturated water (the first refrigerant), and is adiabatically compressed in the heat exchanging pump 44 and supplied again to the heat exchanger 41 to be evaporated. By repeating the above processes, the waste heat of the exhaust fume is recovered at its maximum, thereby driving the turbine 42.

The first refrigerant that is compressed by the heat exchanging pump 44 receives heat from the coolers, that is, the oil cooler 12, the air cooler 13, and the jacket cooler 14, and then receives from the heat accumulator 45 the waste heat discharged from the turbine 42. As the first refrigerant is supplied to the heat exchanger 41, efficiency may be further improved.

As described above, although the heat recovery device 31 is provided in the present embodiment, if the first refrigerant used for the heat exchanger 41 may recover the heat of high temperature exhaust fume like the refrigerant used for the heat recovery device 31 of the present embodiment, the heat recovery device 31 may be omitted.

Figure 3:
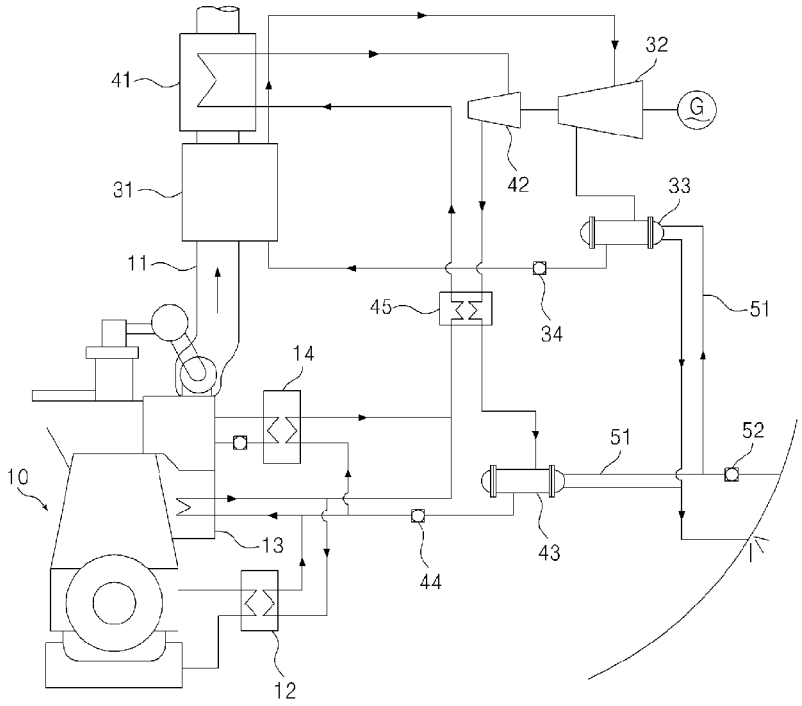
FIG. 3 is a schematic view of a waste heat recovery device for a marine vessel according to a 2nd embodiment of the present invention.

FIG. 3 is a schematic view of a waste heat recovery device for a marine vessel according to a 2nd embodiment of the present invention.

In the present embodiment, compared with the first embodiment, only a part of a structure is different from the first embodiment and the other structure is the same as that of the first embodiment of FIG. 2, only a different part of the structure is described in the following description of the present embodiment.

Referring to FIG. 3, in the waste heat recovery device for a marine vessel according to the second embodiment of the present invention, in addition that the heat exchanger 41 is provided on the exhaust pipe 11 at the rear end of the heat recovery device 31, and the turbine 42 that is driven by using the heat recovered from the heat exchanger 41, the condenser 43 that condenses the gas (the first refrigerant) of the turbine 42, and the heat exchanging pump 44 that compresses the condensed condensate water (the first refrigerant) are provided to additionally recover the waste heat of the exhaust fume, which is the same cycle as that of the above-described first embodiment, there is an additional cycle of driving an auxiliary turbine 32 by continuously recovering the waste heat of the exhaust fume by repeating the processes of driving the auxiliary turbine 32 by recovering the heat of the exhaust fume through the heat recovery device 31 that is provided on the exhaust pipe 11 of the engine 10 that discharges the exhaust fume, condensing a second refrigerant in an auxiliary condenser 33, compressing the condensed second refrigerant in an auxiliary pump 34, and supplying the compressed second refrigerant supplied to the heat recovery device 31 again.

The operation of the waste heat recovery device for a marine vessel according to the second embodiment of the present invention configured as above is described below.

First, the second refrigerant is in a superheated steam state by recovering (heating under uniform pressure) the heat of the exhaust fume through the heat recovery device 31. Next, as the second refrigerant is adiabatically expanded in the auxiliary turbine 32, the auxiliary turbine 32 is driven and the second refrigerant discharged from the auxiliary turbine 32 is cooled under uniform pressure by the refrigerant (seawater) in the auxiliary condenser 33 to be saturated water, and is adiabatically compressed in the auxiliary pump 34 and supplied again to the heat recovery device 31 to be evaporated. By repeating the above processes, the waste heat of the exhaust fume is continuously recovered, thereby driving the auxiliary turbine 42.

Simultaneously, the heat exchanger 41 recovers (heats under uniform pressure) the heat of the exhaust fume that passed through the heat recovery device 31 so that the first refrigerant is in a superheated steam state. As the first refrigerant is adiabatically expanded in the turbine 42, which is the next process, the turbine 42 is driven and the gas (the first refrigerant) discharged from the turbine 42 is cooled under uniform pressure by the refrigerant in the condenser 43, which is the next process, to be saturated water and is adiabatically compressed in the heat exchanging pump 44, which is the next process, and supplied again to the heat exchanger 41 to be evaporated. By repeating the above processes, the waste heat of the exhaust fume is recovered at its maximum, thereby driving the turbine 42.

Also, the first refrigerant compressed by the heat exchanging pump 44 receives heat from the coolers, that is, the oil cooler 12, the air cooler 13, and the jacket cooler 14 and receives again the waste heat discharged from the turbine 42 through the heat accumulator 45, and then is supplied to the heat exchanger 41. Accordingly, efficiency is further improved.

As such, according to the present embodiment, unlike the waste heat recovery device for a marine vessel of a related art, the heat exchanger 41 and the turbine 42 are provided to primarily recover the heat, that is, the waste heat, of the exhaust fume discharged from the engine 10 of a marine vessel through the heat recovery device 31, thereby driving the auxiliary turbine 32, and then, the waste heat is secondarily recovered through the heat exchanger 41 to drive the turbine 42. Accordingly, the heat of the exhaust fume of the engine 10 is fundamentally recovered at its maximum so as to drive the turbines 32 and 42 and thus energy (electricity) generation ability may be improved.

Also, in addition to the above, not only the first refrigerant recovers heat from the coolers 12, 13, and 14 and may be supplied to the heat exchanger 41, but also heat is supplied to the first refrigerant that is supplied from the heat accumulator 45 to the heat exchanger 41 by using the waste heat discharged from the turbine 42, thereby improving efficiency.

Figure 4:
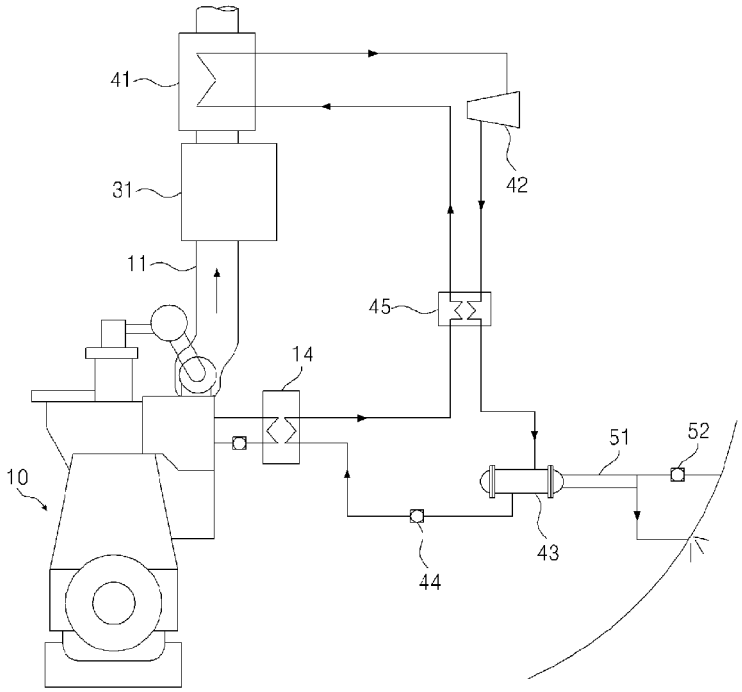
FIG. 4 is a schematic view of a waste heat recovery device for a marine vessel according to a 3rd embodiment of the present invention.

FIG. 4 is a schematic view of a waste heat recovery device for a marine vessel according to a 3rd embodiment of the present invention.

In the present embodiment, compared with the first embodiment, only a part of a structure is different from the first embodiment and the other structure is the same as that of the first embodiment of FIG. 2, only a different part of the structure is described in the following description of the present embodiment.

Referring to FIG. 4, the waste heat recovery device according to the third embodiment of the present invention includes a jacket cooler 14 for cooling the heat generated from the engine 10 and the condensed first refrigerant receives heat from the jacket cooler 14 and re-circulates in the heat exchanger 41. In other words, unlike the first embodiment, in the present embodiment, the first refrigerant that is compressed by the heat to exchanging pump 44 receives the heat from the jacket cooler 14 only and is supplied to the heat exchanger 41. Since the first refrigerant receives a relatively larger amount of heat from the jacket cooler 14 than the oil cooler 12 and the air cooler 13, a line passing through the oil cooler 12 and the air cooler 13 is omitted so that an entire cycle may be simplified compared to the first embodiment and efficiency may not be greatly reduced compared to the first embodiment.

Figure 5:
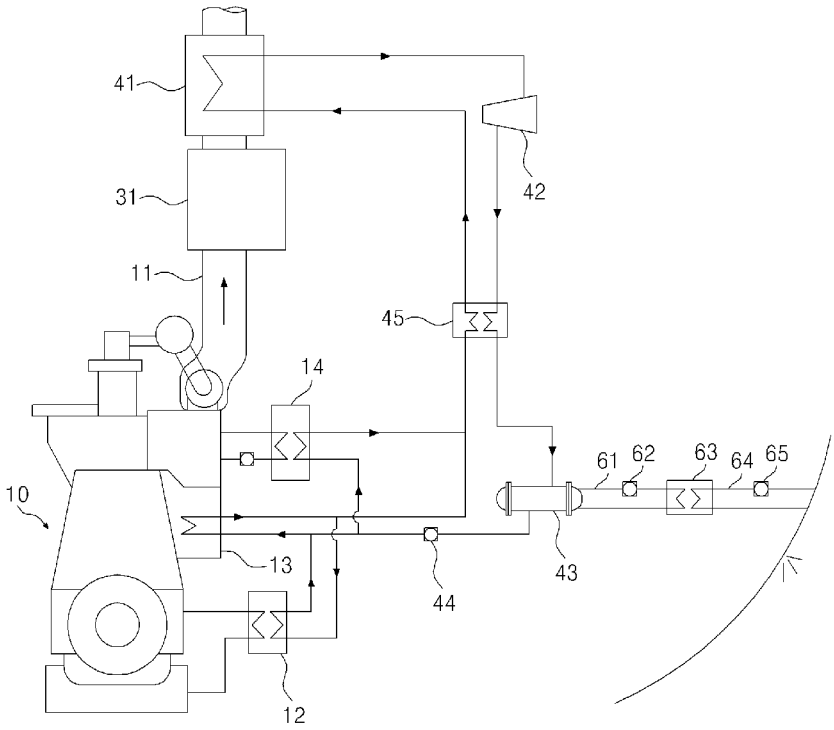
FIG. 5 is a schematic view of a waste heat recovery device for a marine vessel according to a 4th embodiment of the present invention.

FIG. 5 is a schematic view of a waste heat recovery device for a marine vessel according to a 4th embodiment of the present invention.

In the present embodiment, compared with the first embodiment, only a part of a structure is different from the first embodiment and the other structure is the same as that of the first embodiment of FIG. 2, only a different part of the structure is described in the following description of the present embodiment.

Referring to FIG. 5, the condenser 43 of the waste heat recovery device according to the fourth embodiment of the present invention uses a third refrigerant as a refrigerant and the third refrigerant exchanges heat with seawater.

In detail, the waste heat recovery device according to the present embodiment includes a condenser cooling line 61 that is connected to the condenser 43 to supply the third refrigerant to the condenser 43, a condenser cooling pump 62 that forcibly circulates the third refrigerant through the condenser cooling line 61, a seawater heat exchanger 63 in which heat exchange between the third refrigerant and seawater is made, a seawater line 64 connected to the seawater heat exchanger 63 to supply the seawater to the seawater heat exchanger 63, and a seawater pump 65 that forcibly circulates the seawater through the seawater line 64.

In other words, when the condenser 43 is cooled by using seawater, the condenser 43 may corrode. To prevent the corrosion, the condenser cooling line 61 is separately provided and thus the condenser 43 may indirectly exchange heat with the seawater.

Figure 6:
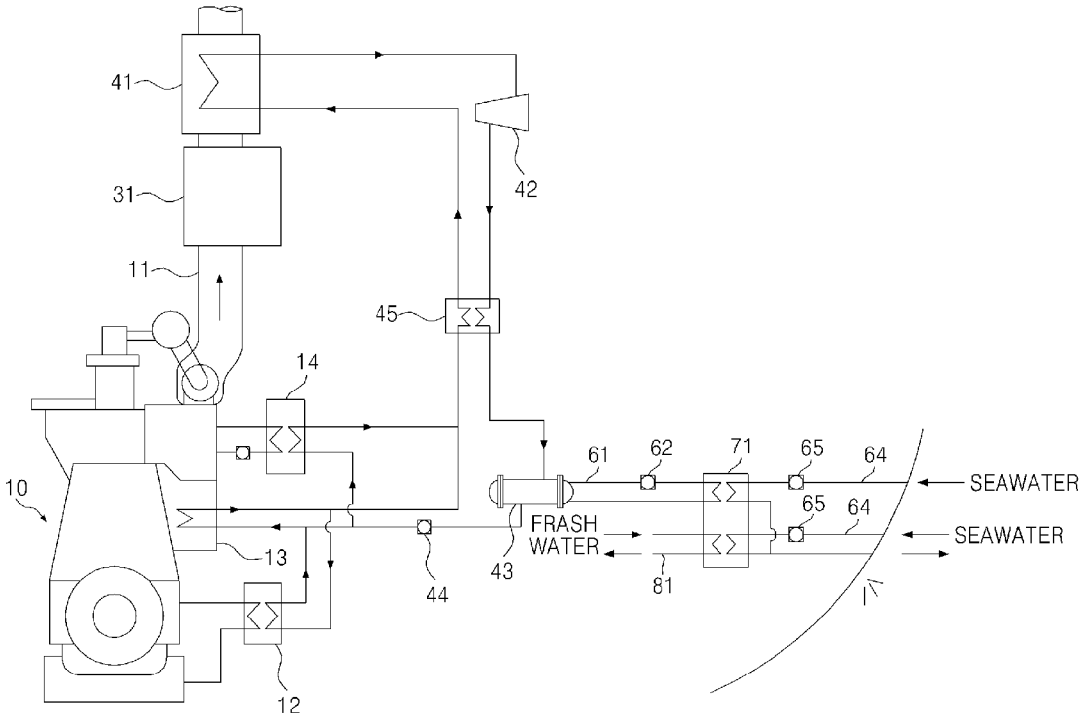
FIG. 6 is a schematic view of a waste heat recovery device for a marine vessel according to a 5th embodiment of the present invention.

FIG. 6 is a schematic view of a waste heat recovery device for a marine vessel according to a 5th embodiment of the present invention.

In the present embodiment, compared with the first embodiment, only a part of a structure is different from the first embodiment and the other structure is the same as that of the first embodiment of FIG. 2, only a different part of the structure is described in the following description of the present embodiment.

Referring to FIG. 6, the waste heat recovery device according to the fifth embodiment of the present invention includes the condenser cooling line 61 that is connected to the condenser 43 to supply the third refrigerant to the condenser 43, the condenser cooling pump 62 that forcibly circulates the third refrigerant through the condenser cooling line 61, a main cooler 71 in which heat exchange between the third refrigerant and seawater and heat exchange between fresh water for cooling and the seawater are performed, the seawater line 64 connected to the main cooler 71 to supply the seawater to the main cooler 71, and the seawater pump 65 that forcibly circulates the seawater through the seawater line 64.

The main cooler 71 is where heat exchange between the seawater and the freshwater for cooling devices in the marine vessel is performed. The fresh water for cooling is supplied through the fresh water line 81 and a fresh water pump (not shown).

Since heat exchange between the third refrigerant for cooling the condenser 43 and the seawater is performed in the main cooler 71, heat is indirectly exchanged between the condenser 43 and the seawater and thus the condenser 43 may be prevented from being corroded by the seawater.

Figure 7:
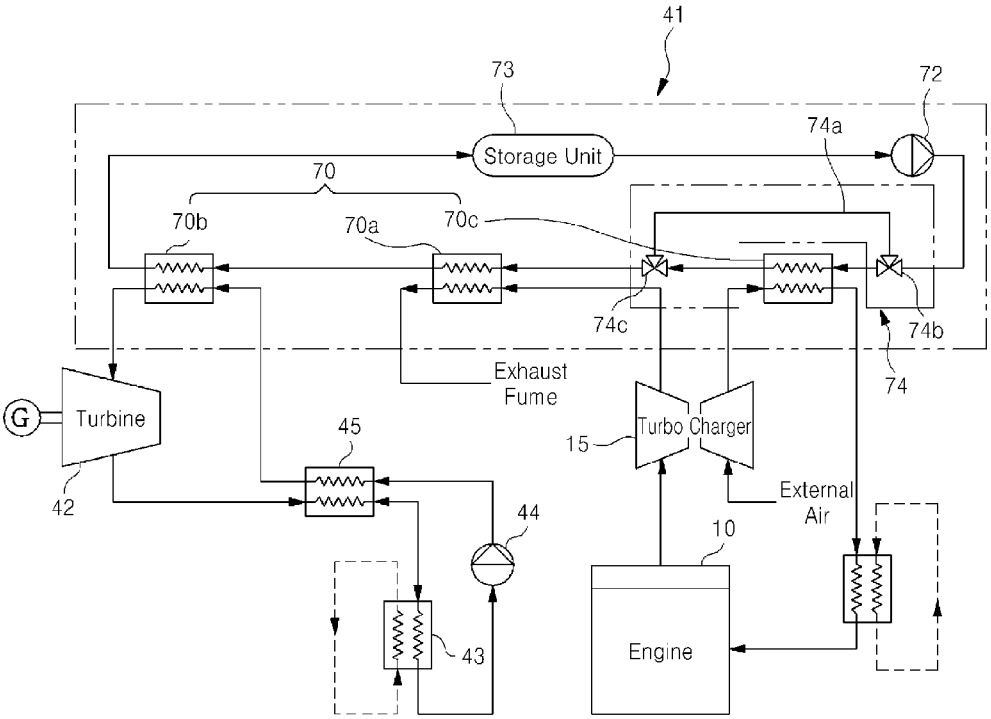
FIG. 7 is a schematic view of a waste heat recovery device for a marine vessel according to a 6th embodiment of the present invention.

FIG. 7 is a schematic view of a waste heat recovery device for a marine vessel according to a 6th embodiment of the present invention.

In the present embodiment, compared with the first embodiment, only a part of a structure is different from the first embodiment and the other structure is the same as that of the first embodiment of FIG. 2, only a different part of the structure is described in the following description of the present embodiment. The reference numerals used in the description of the first embodiment are used for the same parts.

Referring to FIG. 7, the waste heat recovery device for a marine vessel according to the sixth embodiment is operated by using the exhaust fume of the engine 10 that generates a propelling force of the marine vessel, as an energy source, as in the first embodiment.

In detail, the exhaust fume discharged from the engine 10 flows into a turbo charger 15 at a temperature higher than a temperature range of about 240° C. to about 250° C. and the exhaust fume discharged from the turbo charger 15 has a temperature range of about 240° C. to about 250° C. The exhaust fume discharged from the engine 10 is in a high pressure state and the exhaust fume rotates a blade (not shown) provided in the turbo charger 15.

Simultaneously, external air flows into the turbo charger 15. The external air flowing into the turbo charger 15 is compressed by the blade that is rotated by the exhaust fume supplied to the turbo charger 15. In the process, the temperature of the external air is increased.

The exhaust fume discharged from the turbo charger 15 may be supplied to a heat exchange portion 70 that is provided in the heat exchanger 41. The exhaust fume may be supplied to a first heat exchange unit 70*a* of a plurality of heat exchange units that are provided in the heat exchange portion 70.

On the other hand, the heat exchanger 41 may be provided with piping to allow a heat transfer fluid to continuously circulate therein.

The heat transfer fluid is heated to a predetermined temperature through the heat exchange with the exhaust fume to circulate along an arrangement path of the heat exchanger 41.

Although the heat transfer fluid is not specifically defined in the present embodiment, the heat transfer fluid may stably maintain initial physical viscosity without being oxidized by the high-temperature exhaust fume. For example, the heat transfer fluid may be water or thermal oil.

The first heat exchange unit 70*a* may supply heat to the heat transfer fluid through the heat exchange with the exhaust fume.

Simultaneously, the external air flowing into the turbo charger 15 may be heated to a predetermined temperature and move to a third heat exchange unit 70*c*.

The third heat exchange unit 70*c* may heat the heat transfer fluid by performing heat exchange between the external air heated by the turbo charger 15 and the heat transfer fluid circulating in the interior of the heat exchanger 41.

In other words, the heat transfer fluid may be heated to a predetermined temperature in the third heat exchange unit 70*c* before being moved to the first heat exchange unit 70*a* and then heated again in the first heat exchange unit 70*a* by the exhaust fume discharged from the turbo charger 15.

The air discharged from the third heat exchange unit 70*c* may be cooled by the seawater and then supplied to the engine 10.

The first heat exchange unit 70*a* may exchange heat between the heat transfer fluid and the exhaust fume discharged from the turbo charger 15 so as to heat the heat transfer fluid. The first heat exchange unit 70*a* may have a heat exchange size that is relatively larger than that of the above-described third heat exchange unit 70*c*.

The second heat exchange unit 70*b* heats the first refrigerant by performing heat exchange between the heat transfer fluid supplied from the first heat exchange unit 70*a* and the first refrigerant that drives the turbine 42. In other words, thermal energy of the heat transfer fluid is transferred to the first refrigerant in the second heat exchange unit 70*b*.

In the present embodiment, an organic refrigerant may be used as the first refrigerant and an organic compound may be used as the organic refrigerant. Also, since a boiling point of the first refrigerant is low, evaporation of the first refrigerant may be stably performed at a low temperature and the first refrigerant in a steam state may rotate the blade inside the turbine 42.

A Freon-based refrigerant and a hydro carbon series material such as propane may be mainly used as the first refrigerant. For example, the first refrigerant may be any one of R134a, R245fa, R236, R401, and R404 that are suitable for use in a relatively low heat source (400° c. Or low).

The first refrigerant exhibiting the above properties is evaporated by absorbing heat from the second heat exchange unit 70*b* and is supplied to the turbine 42.

The turbine 42 generates electricity by driving a generator G by using the first refrigerant as an energy source.

The first refrigerant may be moved to the heat accumulator 45 via the turbine 42. The first refrigerant that passed through the heat accumulator 45 may be liquefied in the condenser 43 where the first refrigerant performs heat exchange with the seawater, and circulated in and supplied to the heat accumulator 45 by being pumped by the heat exchanging pump 44.

The first refrigerant may be supplied to the second heat exchange unit 70*b* via the heat accumulator 45.

In the following description according to the present embodiment, the heat exchanger 41 is described in detail.

The above-described heat exchange portion 70, that is, the first heat exchange unit 70*a*, the second heat exchange unit 70*b*, and the third heat exchange unit 70*c* may be serially arranged. At least one circulation pump 71 may be provided in the heat exchanger 41 to circulate the heat transfer fluid.

A circulation pump 72 may be arranged at the front end of the third heat exchange unit 70*c*, but the right scope of the present invention is not limited thereto.

The heat exchanger 41 may further include a storage unit 73 for temporarily storing the heat transfer fluid that passes through the heat exchange portion 70, that is, the first heat exchange unit 70*a*, the second heat exchange unit 70*b*, and the third heat exchange unit 70*c*. The storage unit 73 may store a larger amount of the heat transfer fluid than a flow rate of the heat transfer fluid that circulates in the heat exchanger 41 to prevent a shortage of the heat transfer fluid.

The heat transfer fluid that passed through the second heat exchange unit 70*b* is temporarily stored in the storage unit 73 and pumped by the circulation pump 72 to be moved and supplied to the third heat exchange unit 70*c*.

Also, the heat exchanger 41 may further include a bypass portion 74 that allows the heat transfer fluid that passed through the circulation pump 72 to flow toward the first heat exchange unit 70*a* bypassing the third heat exchange unit 70*c*.

The bypass portion 74 may include a bypass pipe 74*a*, a first valve 74*b* that supplies the heat transfer fluid to the bypass pipe 74*a* or to the third heat exchange unit 70*c*, and a second valve 74*c* that joins the heat transfer fluid that passed through the bypass pipe 74*a* to a main flow path.

The first valve 74*b* may regulate a flow rate of the heat transfer fluid such that part or the whole of the heat transfer fluid may flow toward the bypass pipe 74*a* and similarly a flow rate of the heat transfer fluid that is supplied to the third heat exchange unit 70*c*. The first valve 74*b* may regulate the flow rate of the heat transfer fluid that is supplied to the bypass pipe 74*a* and the third heat exchange unit 70*c*, which may be referred to as a flow rate regulator.

Also, the second valve 74*c* may regulate the heat transfer fluid that passed through the bypass pipe 74*a* not to flow toward the third heat exchange unit 70*c*.

In the present embodiment, the first valve 74*b* and the second valve 74*c* are described to be provided as 3 way valve, but the right scope of the present invention is not limited thereto. For example, instead of the first valve 74*b*, a valve may be provided at the bypass pipe 74*a* and a valve may be provided at the front end of the third heat exchange unit 70*c* so that the flow rate of the heat transfer fluid flowing into the bypass pipe 74*a* and the third heat exchange unit 70*c* may be regulated by simultaneously controlling both valves.

The first valve 74*b* and the second valve 74*c* may regulate the heat transfer fluid to flow into the first heat exchange unit 70*a* via the bypass portion 74 without passing through the third heat exchange unit 70*c* when the engine 10 is operated with a full load, and may regulate part of the whole of the heat transfer fluid to flow into the first heat exchange unit 70*a* via the third heat exchange unit 70*c* when the engine 10 is not operated with a full load.

The operation of the waste heat recovery device for a marine vessel according to the sixth embodiment of the present invention configured as above is described with reference to FIG. 7.

During the operation of the marine vessel, the engine 10 may be driven in a full load state and a non-full load state. The full load state signifies not only a state in which the engine is operated with a 100% load, but also a state in which the engine is operated with a similar load so as to provide the heat transfer fluid with a sufficient amount of heat capacity.

In the full load state, the exhaust fume discharged from the turbo charger 15 is supplied to the first heat exchange unit 70*a* so as to heat the heat transfer fluid that circulates in the heat exchanger 41.

When the engine 10 is operated with a full load, since a sufficiently large amount of heat capacity is included in the exhaust fume discharged from the engine 10, the heat transfer fluid may absorb a sufficiently large amount of heat capacity from the first heat exchange unit 70*a*. Accordingly, the heat transfer fluid may flow into the first heat exchange unit 70*a* after passing through the bypass portion 74 without passing through the third heat exchange unit 70*c*.

In other words, the first valve 74*b* may regulate all the heat transfer fluid to move toward the bypass pipe 74*a* and the second valve 74*c* may be regulated to open all flow paths connected to the bypass pipe 74*a*.

The heat transfer fluid heated by the first heat exchange unit 70*a* flows into the second heat exchange unit 70*b* to heat the first refrigerant. The first refrigerant absorbs heat in the second heat exchange unit 70*b* to be evaporated and then supplied to the turbine 42.

The first refrigerant used to generate electricity by being expanded in the turbine 42 may sequentially pass through the heat accumulator 45 and the condenser 43 to be circulated by the heat exchanging pump 44.

On the other hand, when the engine 10 is operated in a non-full load state, that is, the amount of the exhaust fume generated from the engine 10 decreases lower than a predetermine level, the heat capacity included in the exhaust fume may be insufficient to sufficiently heat the heat transfer fluid.

In this case, the heat exchanger 41 may make part of the heat transfer fluid flow into the third heat exchange unit 70*c* to be previously heated.

In detail, as the external air is compressed in the turbo charger 15, the temperature of the external air increases. The external air with the increased temperature flows into the third heat exchange unit 70*c*.

Also, the first valve 74*b* regulates the flow of the heat transfer fluid such that part of the heat transfer fluid flows into the third heat exchange unit 70*c*, not into the bypass pipe 74*a*.

In the third heat exchange unit 70*c*, heat exchange is performed between the air heated by the turbo charger 15 and the heat transfer fluid, thereby heating the heat transfer fluid. In other words, it is not that the part of the heat transfer fluid is heated before flowing into the first heat exchange unit 70*a*.

Accordingly, although the heat capacity included in the exhaust fume supplied to the first heat exchange unit 70*a* decreases, since the heat transfer fluid is supplied in a state of receiving heat capacity before entering the first heat exchange unit 70*a*, the heat capacity discharged from the first heat exchange unit 70*a* may be maintained in a predetermined level.

The first valve 74*b* may regulate the flow rate of the heat transfer fluid that flows into the third heat exchange unit 70*c* corresponding to a changed load amount of the engine 10, that is, a changed discharge amount of the exhaust fume. In particular, the first valve 74*b* may regulate the flow rate of the heat transfer fluid so that the heat capacity included in the heat transfer fluid flowing into the second heat exchange unit 70*b* may be maintained in a predetermined level.

Even when the load of the engine 10 is changed by the above structure and method, the heat capacity that is supplied to the second heat exchange unit 70*b* may be maintained constant. Accordingly, the first refrigerant may be stably evaporated by sufficiently absorbing heat capacity so that the turbine 42 may be stably driven and a generator G may stably generate electricity.

In the following description, a generation system of a marine vessel according to the seventh embodiment is described with reference to FIG. 8. However, compared with the sixth embodiment, in the seventh embodiment, it is a difference that at least one of the first valve and the pump is controlled such that the temperature of the heat transfer fluid that flows into the second heat exchange unit may be maintained constant. Accordingly, the difference from the sixth embodiment is mainly described and the same descriptions and reference numerals are used for the identical parts.

Figure 8:
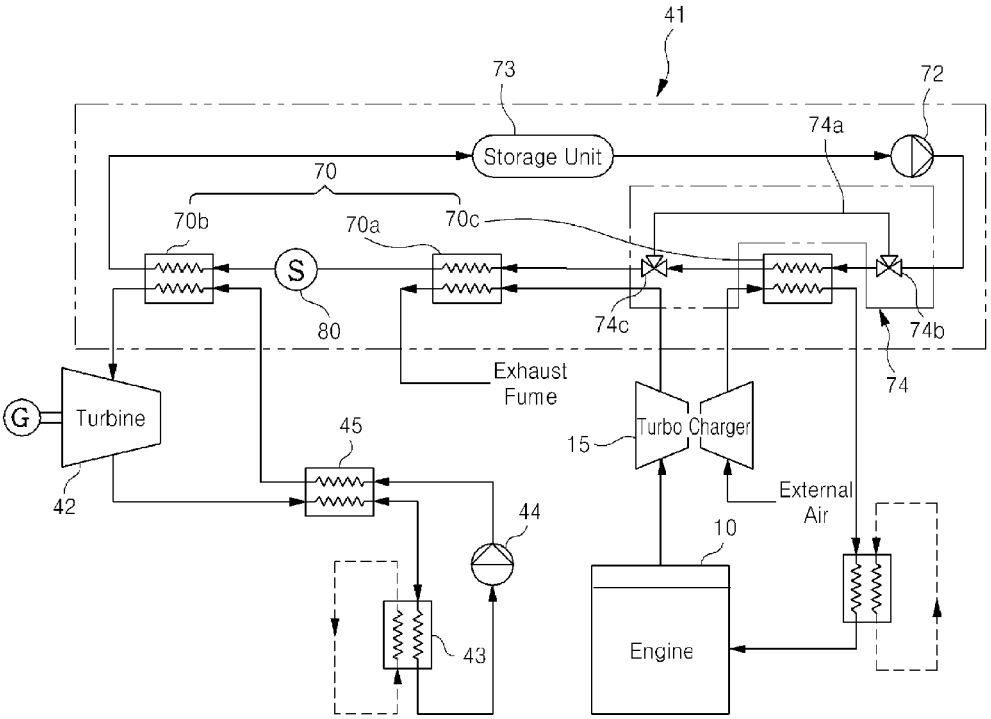
FIG. 8 is a schematic view of a waste heat recovery device for a marine vessel according to a 7th embodiment of the present invention.

FIG. 8 is a schematic view of a waste heat recovery device for a marine vessel according to a 7th embodiment of the present invention.

As it is illustrated in the drawing, in the waste heat recovery device for a marine vessel according to the seventh embodiment of the present invention, even when the load of the engine 10 is changed and thus the discharge amount of the exhaust fume is changed, an electricity generation efficiency of the turbine 42 is maintained constant so that electricity generation may always be performed at an optimal efficiency.

In detail, referring to FIG. 8, the waste heat recovery device for a marine vessel according to the seventh embodiment may include a temperature sensor 80 that measures the temperature of the first refrigerant and is provided at a side of a first refrigerant inlet of the second heat exchange unit.

In the system according to the present embodiment, when the temperature of the heat transfer fluid that flows into the second heat exchange unit 70*b* is constant, the efficiency of the Rankine cycle including the turbine 42 may be maintained constant.

In other words, to allow the Rankine cycle to be operated with a constant efficiency, the first valve 74*b* is regulated so as to regulate the flow rate of the heat transfer fluid supplied to the bypass pipe 74*a* and the third heat exchange unit 70*c*. Accordingly, the flow rate of the heat transfer fluid supplied to the first valve 74*b* may be regulated.

For example, when the load of the engine 10 decreases, the heat capacity included in the exhaust fume decreases. Accordingly, the first valve 74*b* supplies part of the heat transfer fluid toward the third heat exchange unit 70*c* so that the temperature of the heat transfer fluid may be increased. Also, when the flow rate of the heat transfer fluid supplied from the circulation pump 72 to the first valve 74*b* is decreased, the temperature of the heat transfer fluid may be increased by the heat capacity that is supplied from the first heat exchange unit 70*a* and the third heat exchange unit 70*c*.

Reversely, when the load of the engine 10 is increased, contrary to the above-described operation, the temperature of the heat transfer fluid that flows into the second heat exchange unit 70*b* may be decreased by controlling the first valve 74*b* and the circulation pump 72.

As such, the first valve 74*b* and the circulation pump 72 may be independently or parallelly performed.

Accordingly, the temperature of the heat transfer fluid flowing into the second heat exchange unit 70*b* may be maintained constant and thus the turbine 42 may always be driven with an optical efficiency.

While one or more embodiments of the present invention have been described with reference to the figures, it will be understood by those of ordinary skill in the art that various changes in form and details may be made therein without departing from the spirit and scope of the present invention as defined by the following claims. Accordingly, such corrected examples or modified examples may belong to the scope of the present invention.

INDUSTRIAL APPLICABILITY

The present invention may be used for marine vessels including not only marine vessels having a self-operation ability and carrying persons or cargos, but also floating marine structures for storing and loading/unloading cargos, such as, liquefied natural gas-floating production storage offloading (LNG-FPSO), floating storage unit (FSU), etc.

The invention claimed is:

1. A waste heat recovery device for a marine vessel, the waste heat recovery device comprising:

a heat exchanger configured to recover heat from an exhaust fume discharged from an engine and heating a first refrigerant under uniform pressure;

a turbine configured to be driven by adiabatically expanding the first refrigerant heated under uniform pressure;

a condenser configured to condense the first refrigerant adiabatically expanded;

a heat exchanging pump configured to compress the first refrigerant condensed, to be re-circulated in the heat exchanger; and a turbo charger configured to be operated by the exhaust fume, wherein the heat exchanger comprises a heat exchange portion arranged between the turbo charger and the turbine and configured to perform heat exchange between an exhaust fume discharged from the turbo charger and the first refrigerant supplied to the turbine, wherein the heat exchange portion comprises:

a first heat exchange unit configured to perform heat exchange between the exhaust fume discharged from the turbo charger and heat of the heat transfer fluid; and a second heat exchange unit configured to perform heat exchange between exhaust fume discharged from the first heat exchanger and the first refrigerant supplied to the turbine.

2. The waste heat recovery device of claim 1, wherein the heat exchange portion further comprises a third heat exchange unit that is arranged at a front end of the first heat exchange unit and performs heat exchange between air supplied by the turbo charger and the heat transfer fluid to heat the heat transfer fluid.

3. The waste heat recovery device of claim 2, wherein the heat exchanger further comprises a bypass portion that allows the heat transfer fluid to flow toward the first heat exchange unit bypassing the third heat exchange unit.

4. The waste heat recovery device of claim 3, wherein the bypass portion further comprises a regulation valve to regulate a flow rate of the heat transfer fluid.

5. The waste heat recovery device of claim 4, wherein the regulation value regulates a flow rate of the heat transfer fluid that is supplied to the third heat exchange unit, corresponding to a change in a load of the engine.

6. The waste heat recovery device of claim 1, wherein the heat exchanger further comprises a storage unit for temporarily storing the heat transfer fluid.

7. The waste heat recovery device of claim 4, wherein the regulation value regulates a flow rate of the heat transfer fluid that is supplied to the third heat exchange unit to maintain heat capacity supplied to the second heat exchanger unit in a constant level.

8. The waste heat recovery device of claim 4, wherein a temperature sensor to measure a temperature of the heat transfer fluid supplied to the second heat exchange unit is provided at a front end of the second heat exchange unit, and the regulation valve regulates a flow rate of the heat transfer fluid that is supplied to the third heat exchange unit to maintain the temperature of the heat transfer fluid supplied to the second heat exchanger unit in a constant level based on a value sensed by the temperature sensor.

9. The waste heat recovery device of claim 1, wherein the heat exchanger comprises at least one circulation pump for circulation of a heat transfer fluid that circulates in the heat exchange portion, and wherein the at least one circulation pump is configured to regulate a flow rate of the heat transfer fluid to maintain a temperature of the heat transfer fluid constant, the heat transfer fluid performing heat exchange with the first refrigerant.

* * * * *